United States Patent [19]

Stiegeler

[11] Patent Number: 4,772,343

[45] **Date of Patent: * Sep. 20, 1988**

[54] ARTIFICIAL RIBBONED FLOWER MAKING METHODS AND END PRODUCTS

[76] Inventor: Pamela S. Stiegeler, 800 Johnson St., Box 1290, Coos Bay, Oreg. 97420

[ * ] Notice: The portion of the term of this patent subsequent to Oct. 14, 2003 has been disclaimed.

[21] Appl. No.: 880,962

[22] Filed: Jul. 1, 1986

[51] Int. Cl.[4] ..... A41G 1/00

[52] U.S. Cl. ..... 156/61; 156/93; 428/26; 428/102

[58] Field of Search ..... 156/61, 93; 428/24, 428/25, 26, 102

[56] References Cited

U.S. PATENT DOCUMENTS

| | | | |
|---|---|---|---|
| 154,781 | 9/1874 | Barnes | 428/25 |
| 1,415,764 | 5/1922 | Austin | 428/25 |
| 1,568,859 | 1/1926 | Rosas | 428/26 |
| 1,749,526 | 3/1930 | Compton | 428/26 X |
| 1,766,351 | 6/1930 | Patterson | 428/26 |
| 1,879,677 | 9/1932 | Gockel | 428/26 |
| 1,991,602 | 2/1935 | Dernehl | 428/24 X |
| 2,041,753 | 5/1936 | Ganz | 428/25 X |
| 2,211,487 | 8/1940 | Baumstark | 428/25 |
| 2,337,099 | 12/1943 | Gutzmann | 428/25 |
| 2,631,396 | 3/1953 | Holmes et al. | 428/26 |
| 3,030,719 | 4/1962 | Enomoto | 428/26 |
| 3,525,660 | 8/1970 | Kerrigan | 428/26 |
| 3,834,976 | 9/1974 | Mottel | 428/7 X |
| 4,616,769 | 10/1986 | Stiegeler et al. | 428/15 X |

*Primary Examiner*—Henry F. Epstein

*Attorney, Agent, or Firm*—Henderson & Sturm

[57] ABSTRACT

A method of producing a wide variety of ribbon flowers; wherein, a framework unit (10) is employed in conjunction with a length of ribbon (18) a stitching means (11) and a severing means (12), to produce the basic core elements of the various flower varieties; wherein, all of the essential core elements are produced by following the same basic method steps; and, the individual flower varieties are arrived at by selecting options among the broad basic method steps, and also electing to perform optional method steps intermediate the basic steps to produce the particular varieties.

41 Claims, 10 Drawing Sheets

Figure 1:
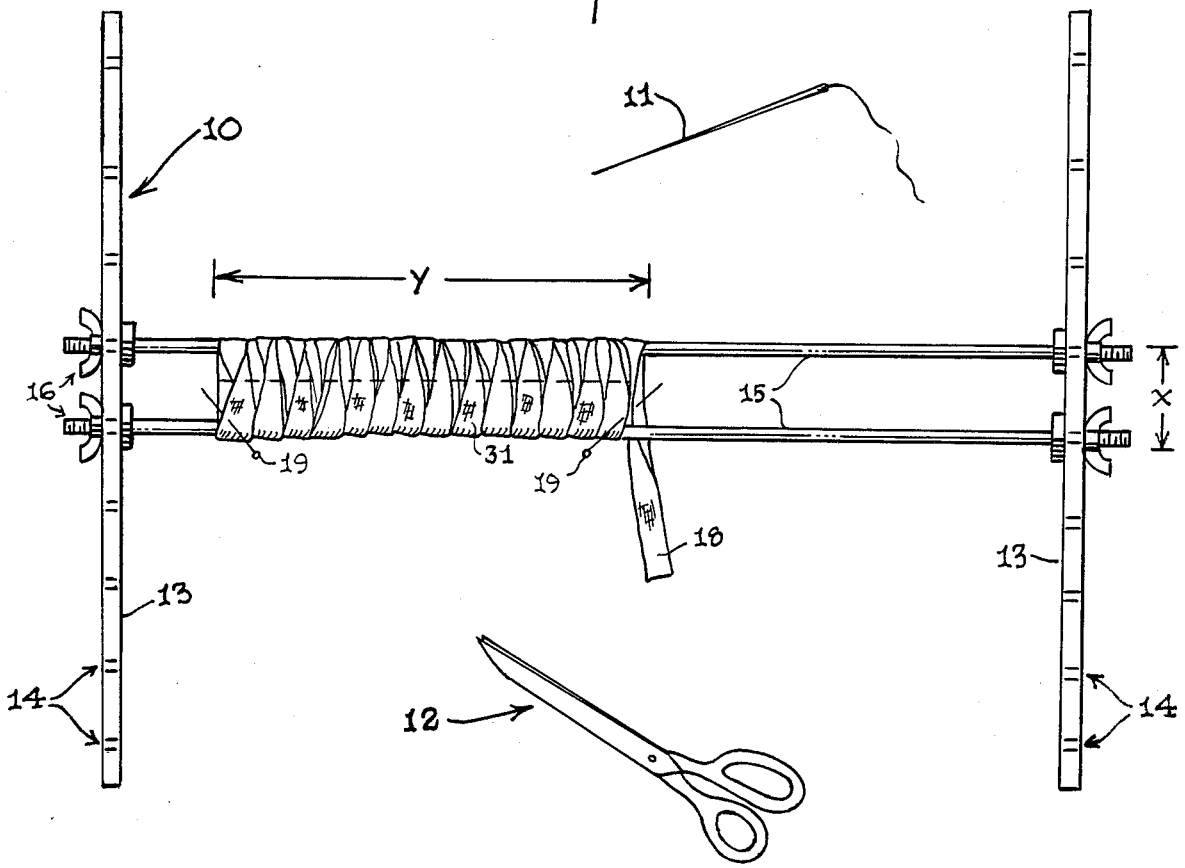

| TYPE OF FLOWER | STRAIGHT STITCH | GATHER STITCH | STRAIGHT WRAP | OVERLAP WRAP | TWIST WRAP | RIBBON SPEC'S | SPEED WRAP SETTING X | FINISHING STEPS REQUIRED |
|---|---|---|---|---|---|---|---|---|
| CLOSED ROSE BUD | e(1) | | | d(2) | | L 2 1/2 YDS W 3/4" | 1" ± | i(1) |
| CRYSANTHEMOMS | e(1) | | d(2) | | d(3) | L VAR W VAR | VAR | i(2) |
| CLOSED CAP MUMS | e(1) | | | | d(3) | L 3-4 YDS W 3/8" | 1/2" | i(2) |
| POM PON MUMS | e(1) | | d(2) | | d(3) | L 6 YDS W 1/8"-1/4" | 2" | i(2) |
| DAHLIAS | e(1) | | | | d(3) | L 4 YDS W 3/8" | 3/4" | i(2) |
| DAISIES | | | d(2) | | d(3) | L 1 1/2 YDS W 1/8" + | 2" | i(4) |
| OPEN ROSES | | e(2) | | d(2) | | L 3 YDS W 1 1/2" ± | 1 1/2" ± | i(2) |
| GLADIOLA | | e(2) | | d(2) | d(3) | L VAR W 2" | 3 1/2" Y=3 | g, h, i(1) |
| POINSETTIAS | | e(2) | | | d(3) | L 3 YDS W 1 1/4" | 3" Y=9 | g, h, i(1) |
| VIOLETS | | e(2) | | | d(3) | L 2/3 YD W 7/8" | 1" Y=5 | h, i(1) |
| BACHELOR BUTTONS | | e(2) | | | | L 2/3 YD W 5/8" ± | 1" ± Y=6 | h, i(1) |
| CARNATIONS | | e(2) | | d(2) | | L 4-5 YDS W 7/8" | 1 1/2" ± | g, i(2) |
| PINE CONES | e(1) | | | | d(3) | L VAR W 3/8" ± | 1/2" | i(3), i(4) |
| HYACINTH | e(1) | | d(2) | | | L VAR W 3/8" | 1" | i(3) |
| AZALEAS (UPPER) | | e(2) | | d(2) | | L 1 1/4 YD W VAR | 3/4" | i(2) |
| " " (LOWER) | | e(2) | | d(2) | | L 1/4 YD W VAR | 1 1/2" | i(2) |

FIG. 33

ARTIFICIAL RIBBONED FLOWER MAKING METHODS AND END PRODUCTS

TECHNICAL FIELD

The present invention relates to the manufacturing of diverse artificial flowers from ribbon material and the various end products produced thereby.

BACKGROUND OF THE INVENTION

This application contains some common subject matter that was disclosed in my co-pending application Ser. No. 06/644,462, filed August 27, 1984 now U.S. Pat. No. 4,616,769 and entitled "Doll Hair Maker and Method of Use".

The present invention employs the same basic method and apparatus disclosed in the above identified co-pending application; however, each variety of artificial flower requires subtle variations in the basic method to produce the desired diverse end products. (i.e. different species of flowers).

While methods and apparatus for fabricating artificial flowers are well represented in the prior art; as can be seen by reference to U.S. Pat. Nos. 154,781; 3,525,660; 1,415,764; 1,991,602; 2,211,487; and, 2,337,099; none of these references employ a flexible, flat, elongated length of cloth or fabric ribbon material as the individual flower petal component.

The only known prior art patents that specifically employ cloth or fabric ribbon material as a basic component in their artificial flower constructions are U.S. Pat. Nos. 3,030,719; 1,766,351;and, 1,568,859.

The Patterson reference, U.S. Pat. No. 1,766,351 specifically teaches the cutting of individual lengths of material and then assembling and joining the individual lengths of material into a flower like configuration.

The Rosas reference, U.S. Pat. No. 1,568,859 teaches the use of a reinforced edge ribbon construction, wherein the stiffened ribbon segments are distorted and then assembled in a stacked relationship to produce a desired artificial flower configuration.

The Enomoto reference, U.S. Pat. No. 3,030,719 teaches the zig-zag stitching along the longitudinal axis of a length of ribbon, followed by a draw string type gathering of the ribbon material to produce folded petal segments in the assembly of a finished artificial flower construction.

While all of the aforementioned ribboned artificial flower methods of construction, and end products produced thereby, are adequate for their intended purpose and function; they are woefully deficient in the number and complexity of the steps involved in the fabrication of a given artificial flower, and extremely limited with respect to the number of different flower varieties that can be created by following any given previously patented method that specifically employs ribboned material.

Considering the expense of commercially available artificial flowers, which is due in large part to the time consuming and labor intensive methods used to produce the finished product, as well as the cost of the raw materials currently employed, an attempt was undertaken to develop a new and unique method of fabricating artificial flowers.

Another object of the present invention was the development of a basic method and procedure for creating artificial flowers; wherein, minor variations in the basic procedure would produce drastically different end products representative of different varieties of flowers.

Yet another object of this invention was to develop a method for creating artificial flowers that: would not only lend itself to mass production techniques to lower the cost of the end products produced thereby; but, which would also employ less expensive and commonly available raw materials that would further lower the cost of the finished products.

A still further object of the present invention was to develop a method of producing different artificial flowers using the same basic equipment and certain basic steps; whereby, anyone following the teachings and instructions contained in this specification would be able to reproduce the various end products described herein for their own personal use or for commercial sales purposes.

Still another object of this invention was to develop a method of producing different ribboned artificial flowers; whereby, equally attractive results would be achieved regardless of whether the less expensive craft ribbon or the more expensive woven edge ribbon material was employed in the inventive procedure.

BRIEF SUMMARY OF THE INVENTION

The present invention involves a method of producing different ribboned artificial flower configurations by: wrapping and optionally simultaneously twisting an elongated length of flat cloth or fabric ribbon material onto rods that are positioned at a preselected location on a framework; with the stitching of adjacent ribbon wraps being effected while the ribbon is still secured to the framework; and, in accordance with a preselected pattern to produce a desired flower configuration.

As will be explained in greater detail further on in the specification, the method of this invention can be practiced to produce the following ribbon flower varieties: closed rosebuds; crysanthemums; closed cap mums; pom pon mums; dahlias; daisies; open roses; gladiolas; poinsettias; violets, bachelor buttons; carnations; azaleas; hyacinth; and, even pine cones.

Briefly stated, the same basic steps are repeated for all of the aforementioned ribbon flower varieties; however, some of the intermediate steps in the method require a choice among several options depending on the particular type of ribbon flower that is to be produced. In addition, there are other intermediate steps in the method that will either be followed, or dispensed with, according to the particular flower chosen.

The indispensable method steps that require that an option be made: relate to the winding of the ribbon onto the framework rods; and, the type of stitching that is used to fasten the center of the windings. The winding options involve a choice between straight wrapping; overlapped wrapping; and, twisted wrapping. The stitching options involve: a straight stitch; a single gather stitch; and, a double gather stitch.

The elective intermediate steps involve the steps of cutting and shaping of the looped ends of the ribbon; and, the steps of severing the ribbon material between the double gather stitch.

Once the basic steps and the selected elective intermediate steps have been performed, the particular flower chosen may be attached to a stem member in accordance with one of the following stem wrapping step options: end rolled; overlapping center seam; spiral wrapping; and, encircling attachment to an intermediate stem related element.

At this point individual finishing touches may be applied to the assembled basic flower construction such as the addition of a calyx, flower center, stamens, etc.

BRIEF DESCRIPITON OF THE DRAWINGS

Figure 2:
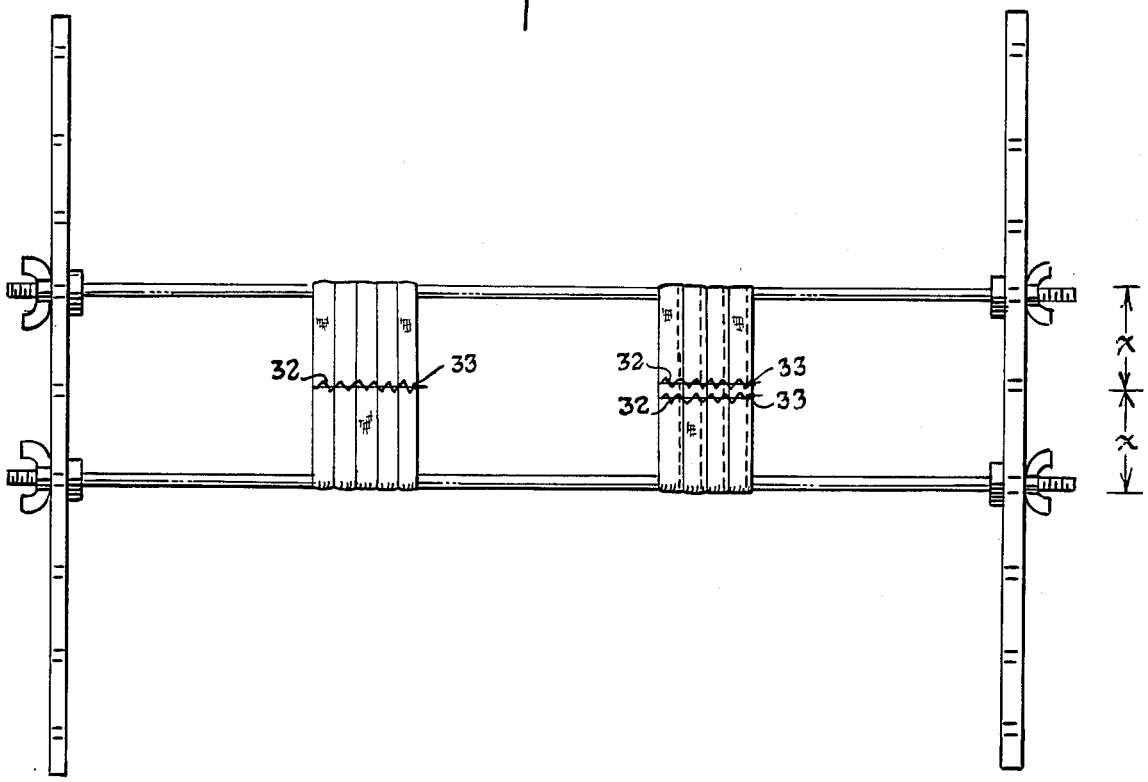
Figure 3:
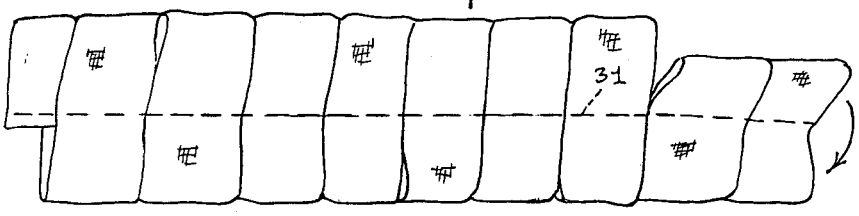
Figure 4:
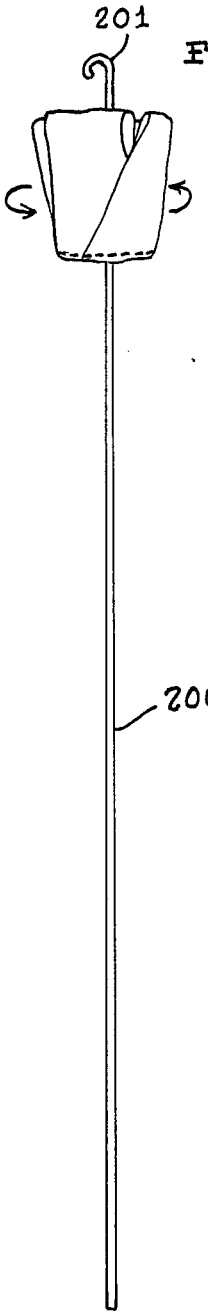
Figure 5:
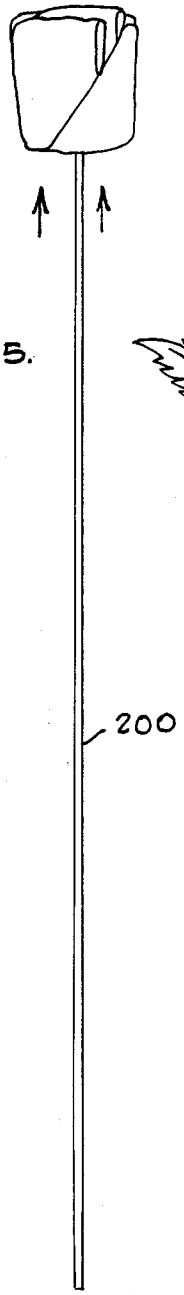
Figure 6:
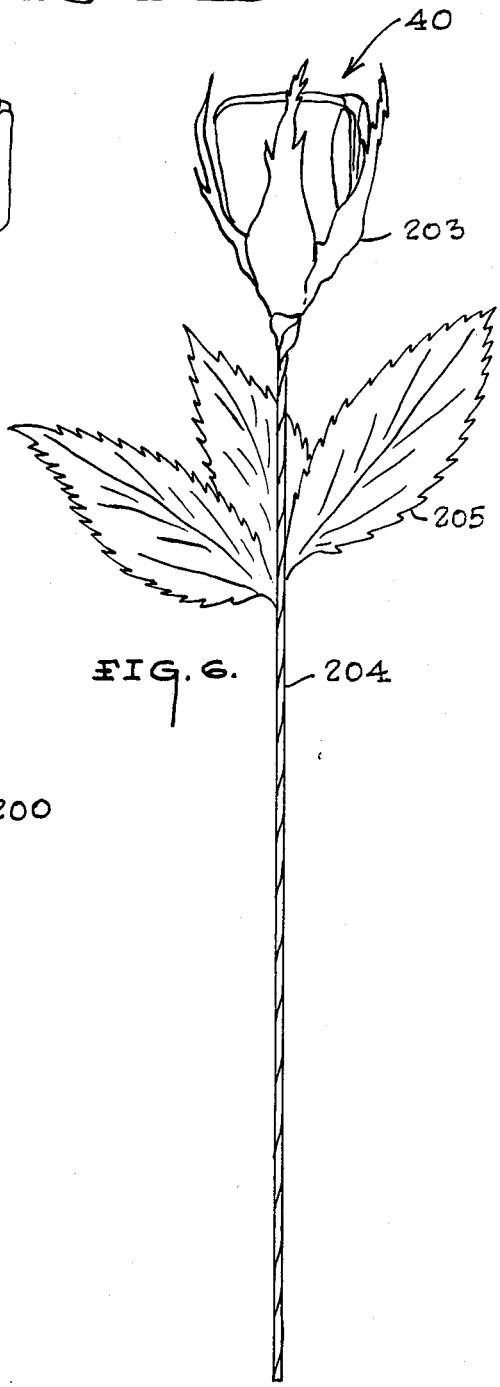
Figure 7:
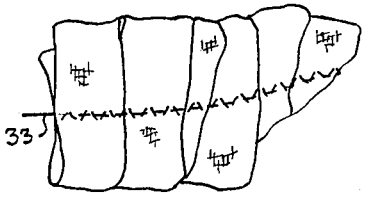
Figure 8:
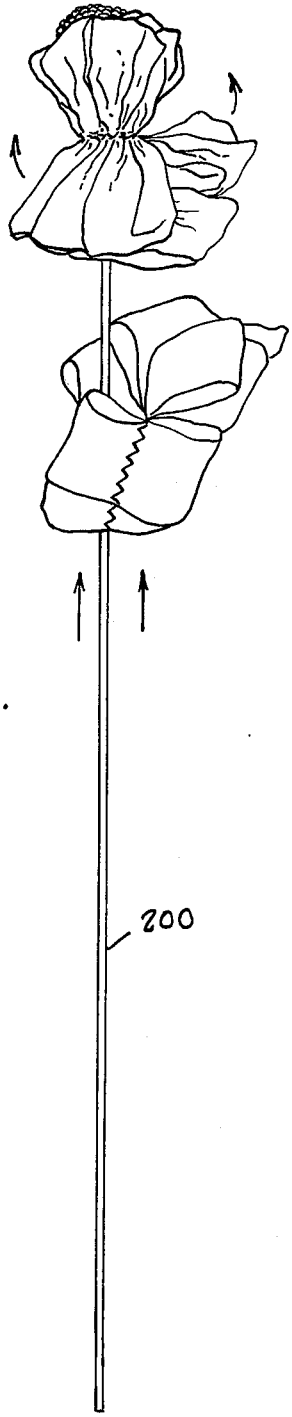
Figure 9:
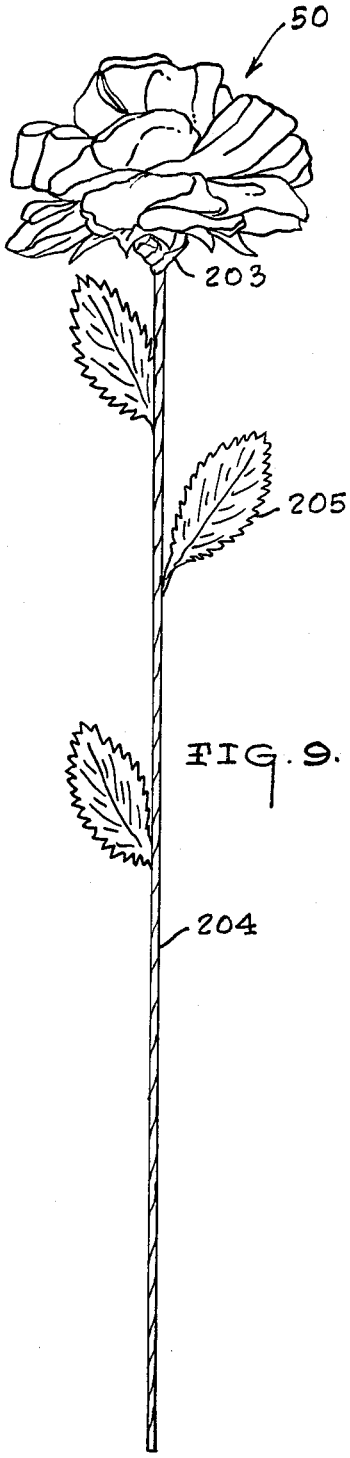
Figure 10:
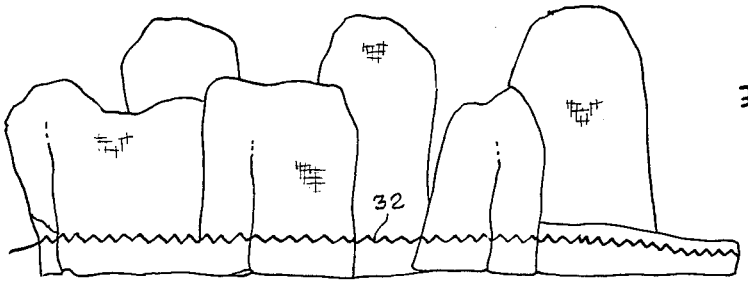
Figure 11:
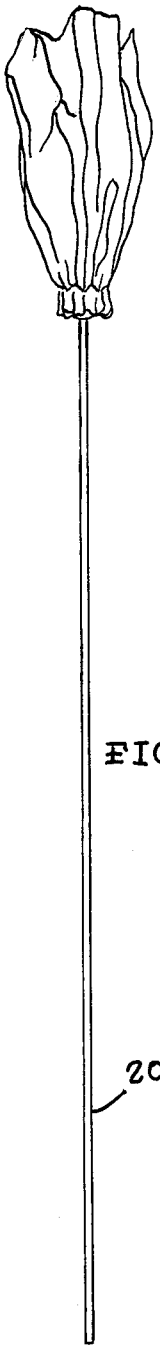
Figure 12:
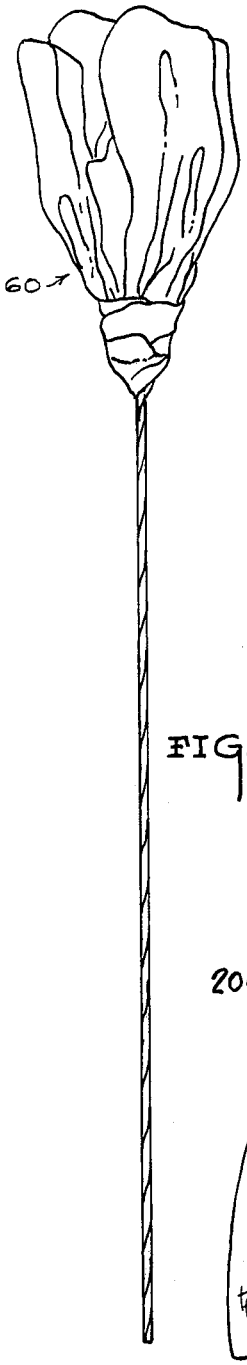
Figure 13:
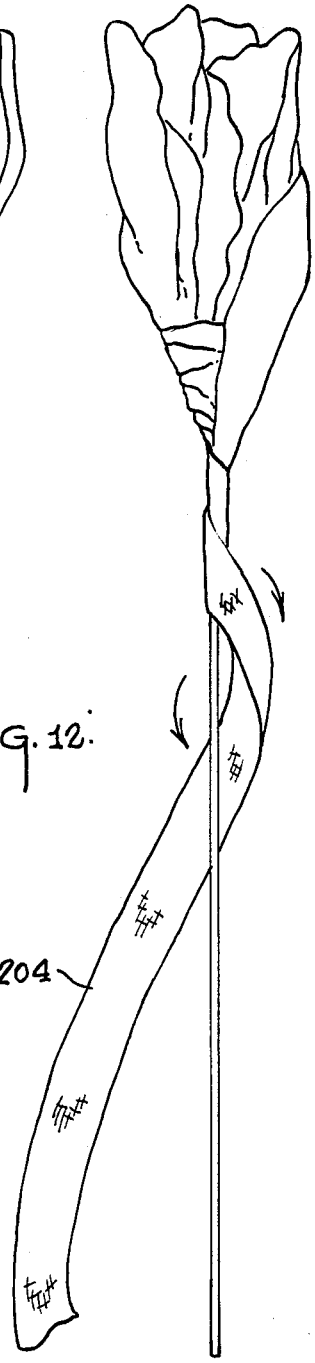
Figure 14:
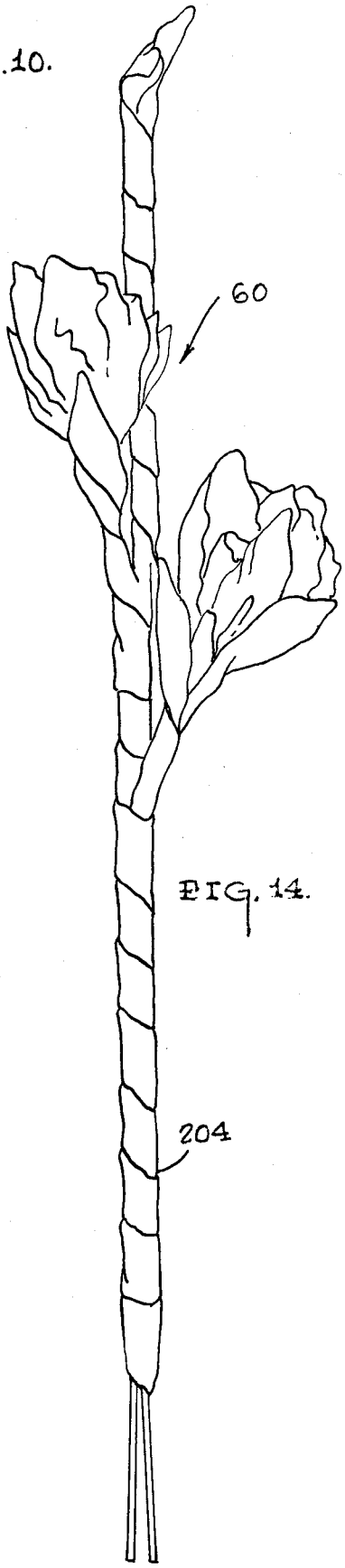
Figure 15:
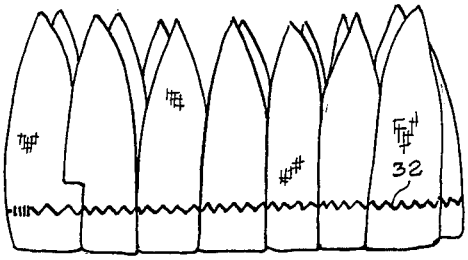
Figure 16:
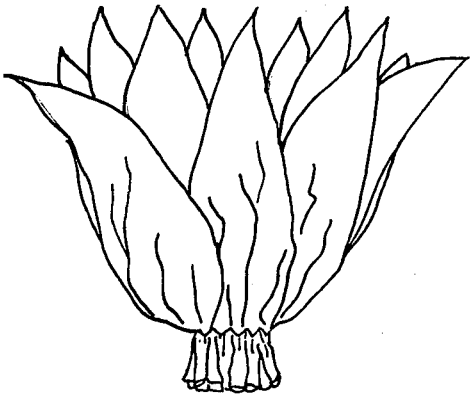
Figure 17:
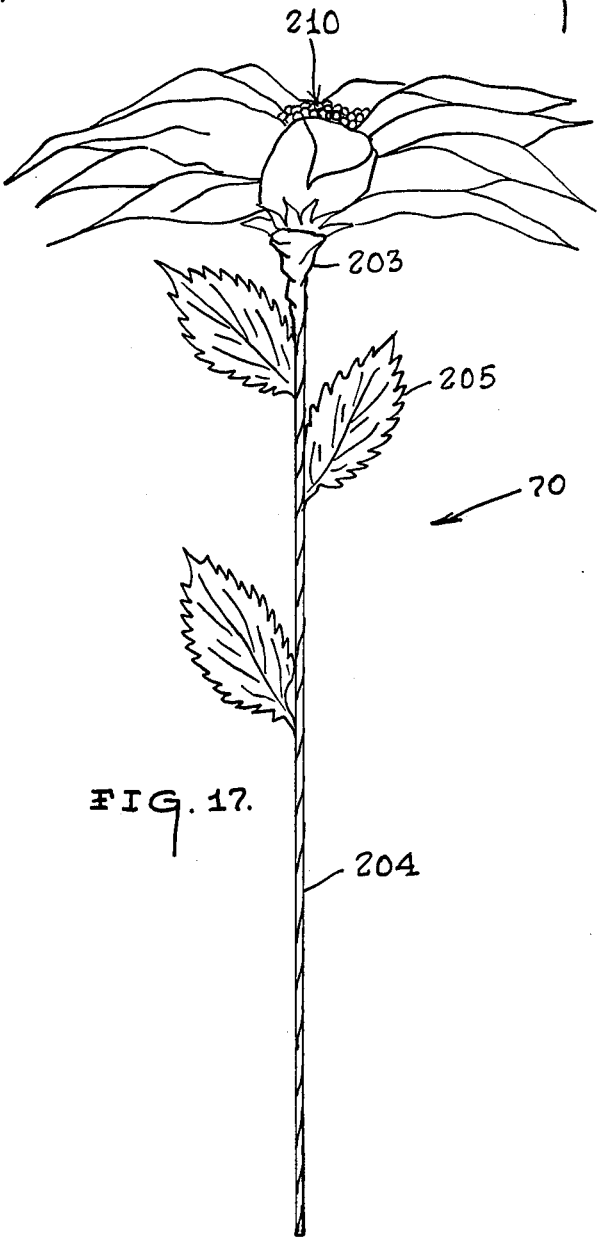
Figure 18:
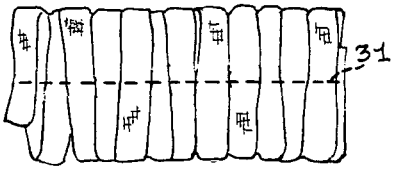
Figure 19:
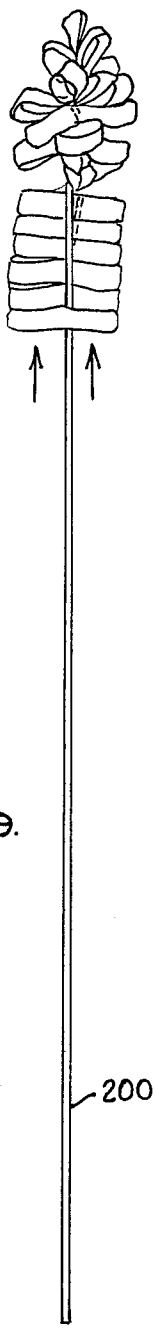
Figure 20:
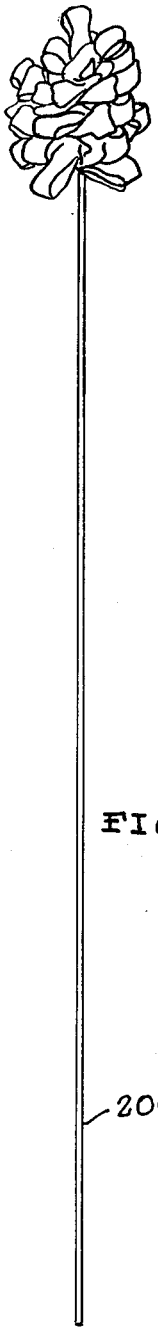
Figure 21:
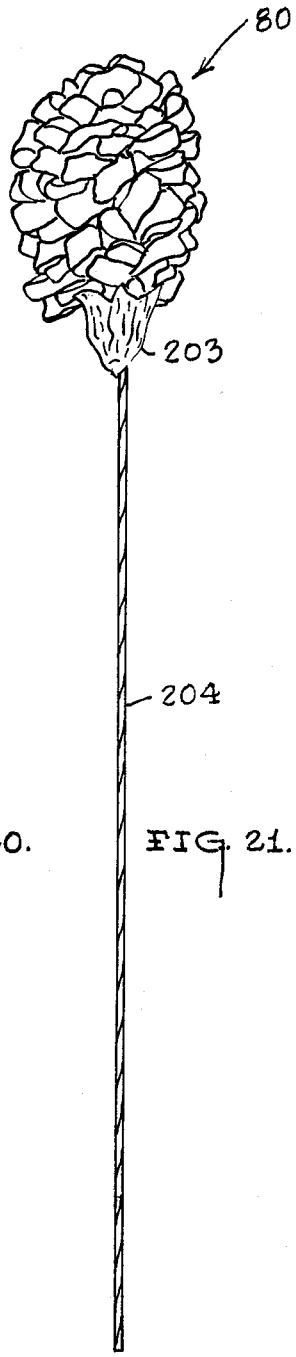
Figure 22:
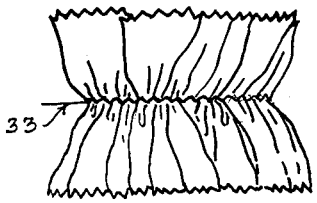
Figure 24:
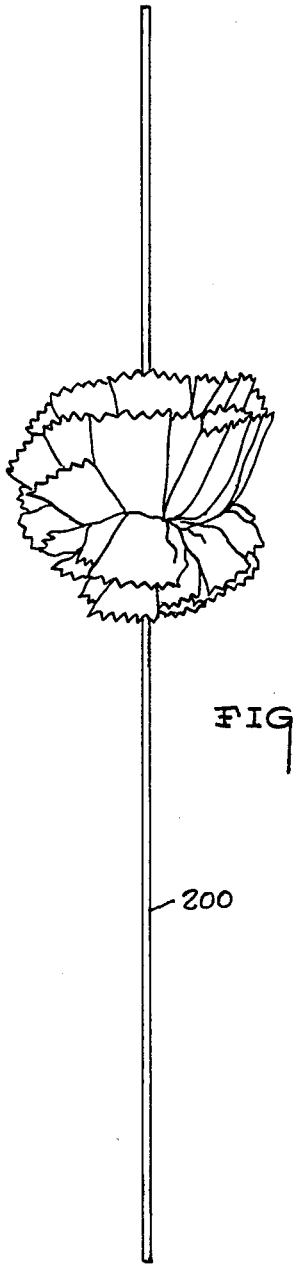
Figure 23:
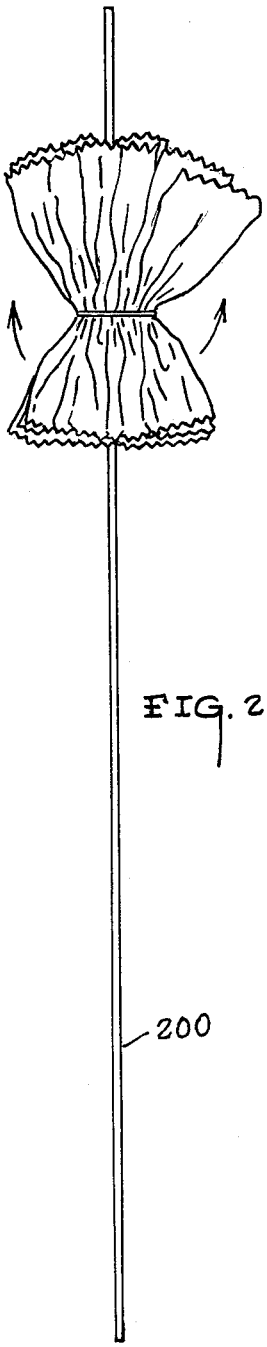
Figure 25:
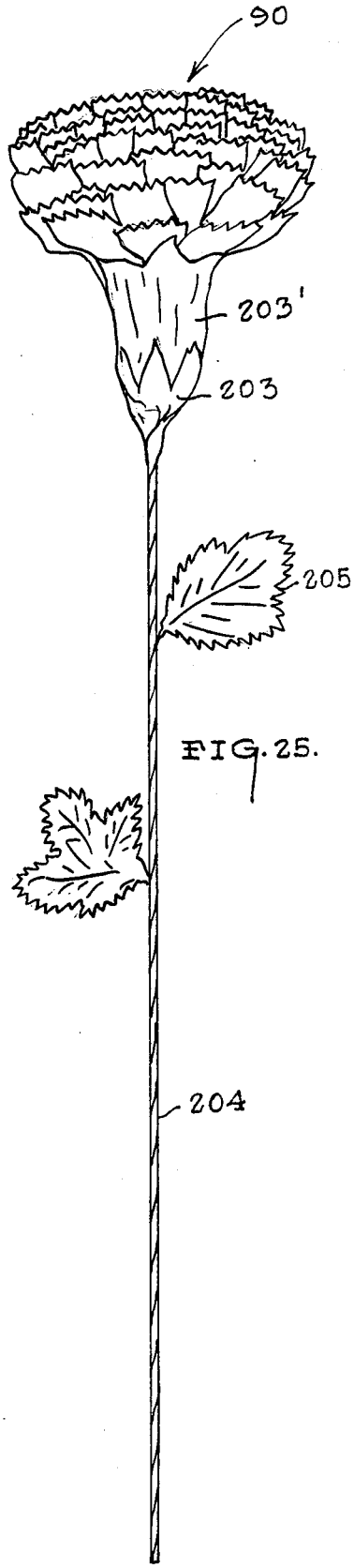
Figure 26:
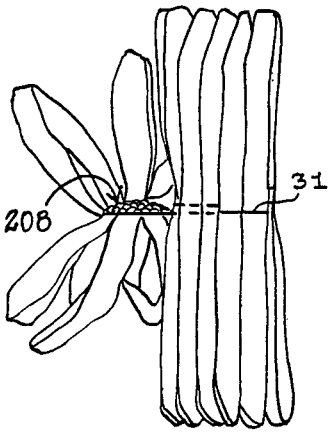
Figure 27:
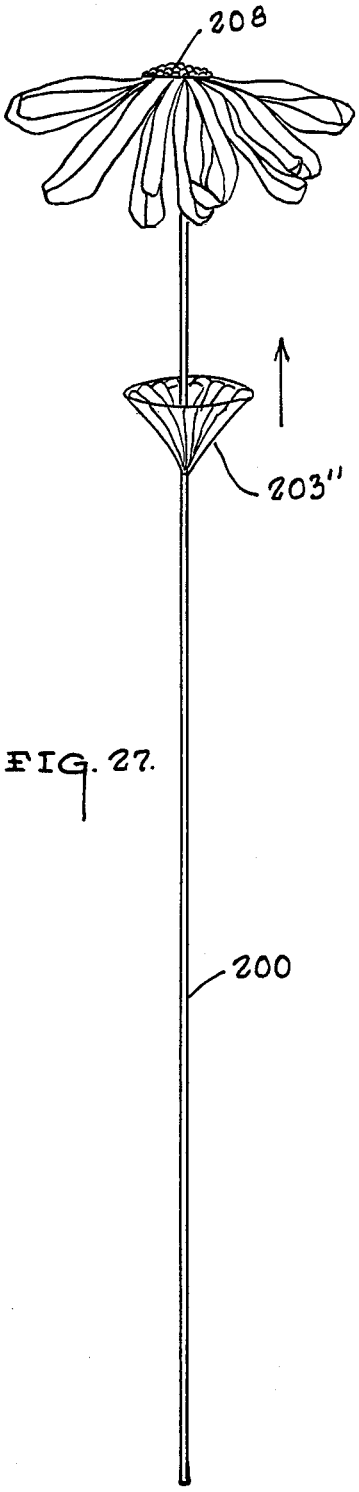
Figure 28:
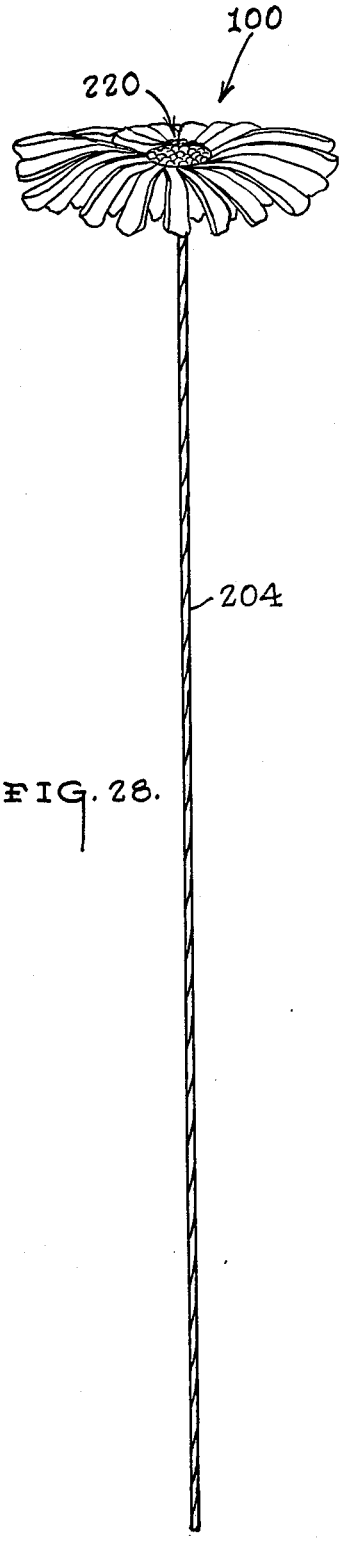
Figure 29:
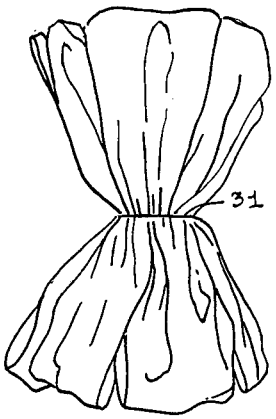
Figure 30:
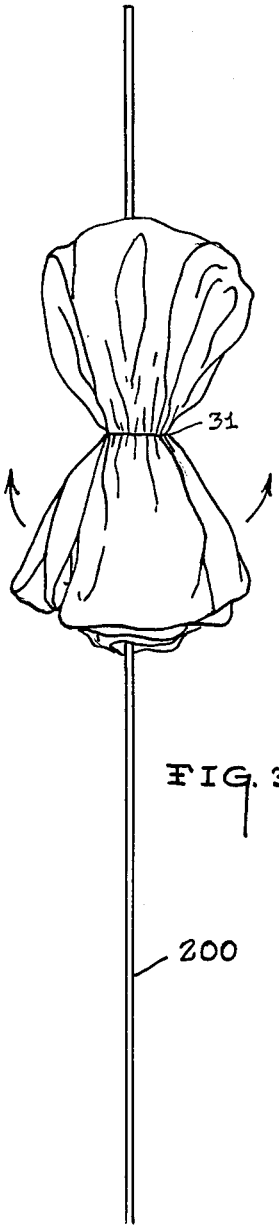
Figure 31:
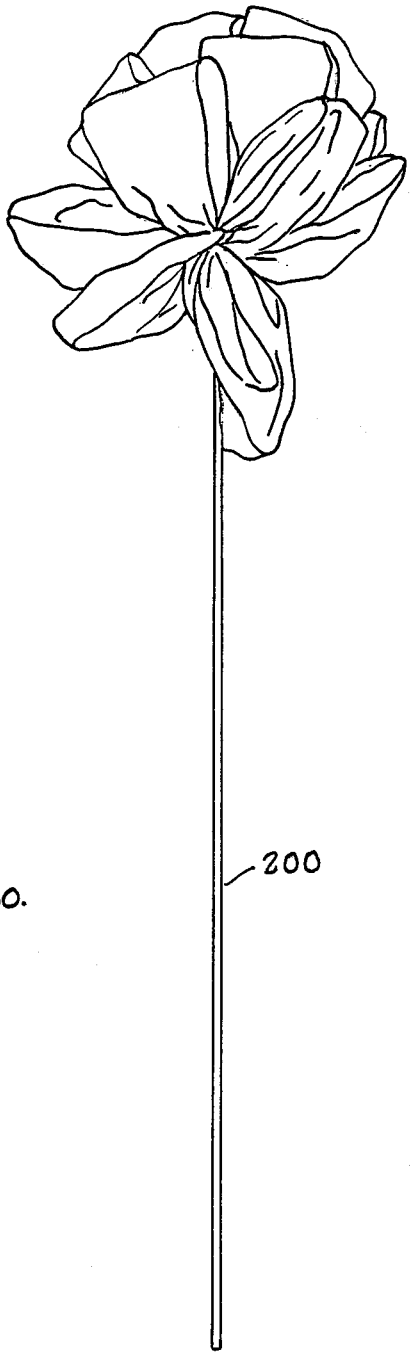
Figure 32:
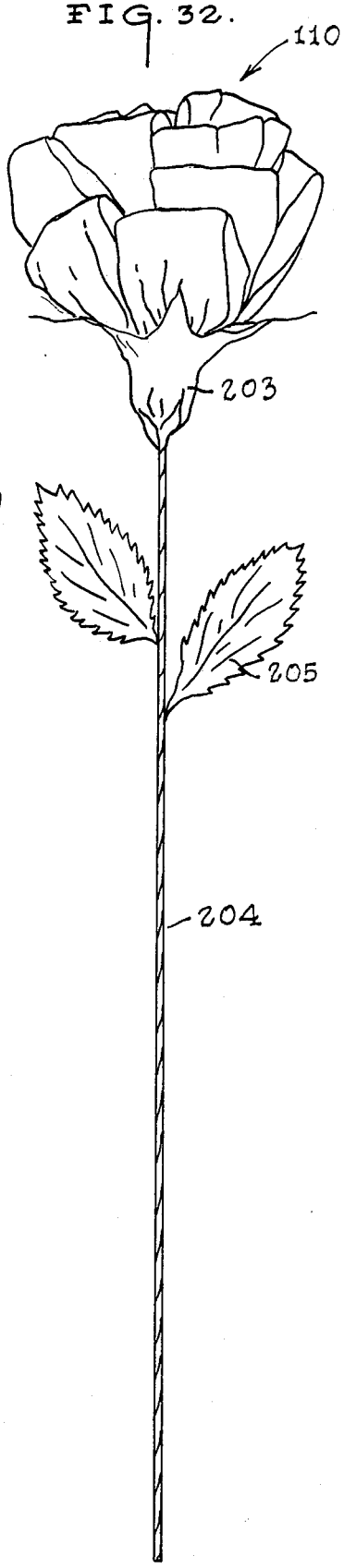

These and other objects, advantages and novel features of the invention will become apparent from the detailed description of the preferred embodiment of the best mode for carrying out the invention which follows; particularly when considered in conjunction with the accompanying drawings, wherein:

FIGS. 1 and 2 illustrate the various: types of stitching; styles of ribbon wraps; representative framework rod spacings; and, representative loop repetition limitations used to practice this invention;

FIGS. 3 thru 6 show various stages of the assembly of a closed rosebud ribbon flower;

FIGS. 7 thru 9 show various stages in the assembly of an azalea ribbon flower;

FIGS. 10 thru 14 show various stages in the assembly of a gladiola ribbon flower;

FIGS. 15 thru 17 show various stages in the assembly of a poinsettia ribbon flower;

FIGS. 18 thru 21 show various stages in the assembly of a hyacinth ribbon flower;

FIGS. 22 thru 25 show various stages in the assembly of a carnation ribbon flower;

FIGS. 26 thru 28 show various stages in the assembly of a daisy ribbon flower;

FIGS. 29 thru 32 show various stages in the assembly of an opened rose ribbon flower; and, FIG. 33 is a chart showing the various method steps required for the fabrication of the different ribboned flowers.

BEST MODE FOR CARRYING OUT THE INVENTION

As can best be seen by reference to FIG. 1, the basic apparatus required to practice the primary method steps of this invention comprise an adjustable framework unit (10) a stitching unit (11) and a severing unit (12). The adjustable framework unit (10) comprises elongated apertured side elements (13) having a plurality of opposed pairs of apertures (14) that are equidistantly spaced from the center of the respective side elements (13). In addition, the adjustable framework unit (10) is further provided with a plurality of elongated rod elements (15) having releasable securing means (16) associated with their ends, whereby the elongated rod elements (15) may be selectively positioned in the opposed pairs of apertures (14) in the framework unit (10).

As shown in FIGS. 1 and 2, the positioning of the rod elements (15) is variable, to accommodate a length of ribbon material (18) that is wrapped around the spaced rod elements (15) a number of times "y"; wherein the value of "y" is related generally to the length of ribbon chosen; or, is directly related to the choice of a particular variety of flower that is to be produced by the method steps of this invention.

As best shown in FIG. 2, the elongated rod elements (15) are spaced from the mid-point of the respective side elements (13) a distance "x"; wherein the preferred value of "x" is determined by the size and particular variety of flower that is chosen to be produced by the method steps of this invention. (see "speed wrap setting" in FIG. 33).

As mentioned earlier on in the specification, the particular ribbon finish (craft, or edge woven) or material (silk, velvet, rayon, or other synthetic fabric) is rarely determinative in practicing the method steps of this invention; as far as, the aesthetically pleasing appearance of the finished product is concerned. In fact, as a practical matter, there is only one variety of flower (poinsettia) in which a specific material (velvet) is considered to be particularly recommended for use.

Again referring back to FIGS. 1 and 2, it can be seen that the wrapping of the ribbon material (18) around the rod elements (15) can be effected in a selected one of the following three wraps (step d): a twist wrap option d(2) (FIG. 1), wherein the ribbon is twisted as it passes over the respective rod elements; a side by side wrap option d(1), shown on the left side of FIG. 2, wherein the loops of ribbon material are disposed adjacent to one another; and, an overlap wrap option d(3), wherein each succeeding loop of ribbon material overlays a portion of the preceeding ribbon loop.

As can also be seen by reference to FIG. 1, each completed ribbon wrapping is temporarily secured, as by pin means (19) at the beginning and end of each of the respective wraps. In addition as shown in FIG. 2, the opposite sides of the ribbon loops are joined by stitching step (e) that extends along, and is disposed proximate to, the mid-point of the ribbon loops.

As was the case with the wrapping, the stitching step (e) involves a choice among the following three types of stitching: a straight (31) overlapping stitch option e(1) (FIG. 1), that runs down the middle of the opposed loops; a single gather stitch option e(2) that comprises a single zig-zag stitch (32) that is imposed over a knotted pull thread (33), wherein the single gather stitch runs down the middle of the opposed loops; and, a double gather stitch option e(3), which comprises two single gather stitches spaced from one another and disposed parallel to the middle of the opposed loops.

While the disclosure of the optional choices within the method steps d and e may seem premature; it was purposefully done at this point due to the fact that the basic method steps that are involved in the fabrication of all of the following illustrated varieties of flowers: closed rosebud (40); azalea (50); gladiola (60); poinsettia (70); hyacinth (80); carnation (90); daisy (100); open rose (110); can now be undertaken.

The basic method that is employed to produce all of the end product ribboned flowers of this invention proceeds as follows:

Step (a) Choosing a selected one of the variety of flowers listed on the chart of FIG. 33;

Step (b) Choosing a ribbon material of a length finish and width compatible with the variety selected in step (a); Step (c) Positioning the rod elements (15) on the framework (10) a mutual distance "x" apart from the mid-point of the side elements (13), in accordance with the choice of step (a);

Step (d) Wrapping the length of ribbon around the rod elements (15) a number of times "y"; wherein the beginning and end of each completed wrap are temporarily secured;

Step (e) Stitching the opposed portions of the ribbon loops proximate their mid-points, while the ribbon wrap is still disposed on the elongated rod elements (15) of the framework (10); and, Step (f) Removing the stitched ribbon wrap from the framework (10).

At this juncture, the core elements of all of the different varieties of flowers that are possible by virtue of this invention, have been fabricated by repeating the same basic method steps. It should further be appreciated that given the wide disparity in the appearance of the different varieties involved; there can be very few remaining basic steps that can be repeated for all varieties.

The following method steps involve optional steps that are only applicable to a limited number of the varieties that are listed on the chart depicted in FIG. 33. These optional steps are:

Step (g) The cutting of the looped ends of the completed ribbon wrap, and the subsequent shaping of the severed ends; and, Step (h) The cutting of the ribbon material intermediate the double gather seams.

Once the basic and the necessary intermediate optional steps have been taken; the core element of each variety is intended to be operatively connected Step (i) to a stem element (200). Step (i) involves a choice among the following options: (i)1, rolling the end of the assembled core element around the stem member (200); (i)2 an overlapping wrapping of the center of the assembled core element around the stem member (200); (i)3 a spiral wrapping of the center of the assembled core element around the stem member (200); and, (i)4 the encircling attachment of the core element to an intermediate member (300) associated with the stem member (200).

Given the fact that certain of the basic steps (a thru c and f) are invariable and repeated for all varieties, these steps have not been included in FIG. 33. Only the basic steps involving choices, and the optional steps are included in FIG. 33; along with the preferred ribbon length (L) and width (W); as well as the preferred values for the speed wrap setting "x"; and, the specific values of "y" for certain flower varieties.

In lieu of a step by step unnecessarily repetitious recital of the steps involved to produce each flower variety, an attempt will be made to briefly summarize the particular finishing touches and assembly techniques that distinguish one particular flower variety from another.

As can be seen by reference to FIGS. 3 thru 6, the closed rosebud (40) is formed by folding the finished ribbon wrap along the center stitch (31), and tightly wrapping the stitched seam in a "jelly roll" fashion around the stem member (200). The core element is then pushed up to engage the stem hook (201); and, the final touches would involve the addition of a calyx member (203) stem covering (204) and leaves (205).

As depicted in FIGS. 7 thru 9, the azalea (50) is formed by upper and lower core elements; wherein the pull thread of each individual core element is pulled and wrapped via step i(2) around the stem member (200). The portion of each core element below the pull thread (33) is pushed upwardly and outwardly; and, then the lower core element is pushed up to engage the upper core element. The finishing touches of the azalea (50) are similar to those of the rosebud.

As shown in FIGS. 10 thru 14, the gladiola (60) is formed by only one of the segments that was created by step (h). In as much as the value of "y" in this instance equals "3", step (g) will have created six severed petal segments that will have to be shaped. As shown in (10) the foreground petals are trimmed down approximately twice as much as the background petals; and when the core element is wrapped around the stem member the shorter foreground petals are always positioned on the inside closest to the stem member.

It should also be noted that with this particular variety, the stem treatment is rather specialized in that: while each flower is attached to its own stem member (200); each stem member is also attached to another stem member in a staggered off-set relationship usually involving an odd number of flowers, and an unadorned upper stem member bent at the top; wherein all of the stem members are wrapped with a relatively wide and thick stem covering (204).

As can be seen in FIGS. 15 thru 17, the poinsettia (70), is formed by using each severed segment to form an individual flower; wherein the nine upper and nine lower petals of each segment are offset relative to one another. At this point a calyx (203) is attached to the stem member (200) below the core element, and a flower center is attached on top of the core element; whereupon, the petals of the poinsettia are flattened into a generally horizontal disposition.

As shown in FIGS. 18 thru 21, the hyacinth (80) is formed by spirally wrapping successive core elements around the stem member (200); and, pushing each successive core element up against the preceeding core element, until the desired height of the hyacinth blossom is attained. At this point the finishing touches would involve the addition of a calyx (203) and stem wrapping (204).

As depicted in FIGS. 22 thru 25, the carnation (90) is formed by severing the looped ends of the completed ribbon wrap with a pinking shears; wherein, the ends of the petal segments acquire the distinctive serrated edge effect of a real carnation. At this point the pull thread (33) of the single gather stitch is pulled and wrapped around the stem member (200) in accordance with step (i)2; and, the portion of the core element below the pull thread is pushed upwardly and outwardly with respect to the stem member (200). To achieve a truly realistic looking carnation, at least two identical core elements are successively wrapped around the stem member in accordance with step (i)2, prior to pushing the lower portions of the respective elements in an upward and outward direction. The finishing touches of the carnation (90) while following the most often repeated flower finishing techniques (i.e. stem wrapping (204); leaves (205); and, calyx (203)) also require a specialized elongated calyx (203') whose length and configuration is quite distinctive from the typical flower calyx employed in the majority of instances.

As illustrated in FIGS. 26 thru 28, the daisy (100) is formed by adhesively securing the core element center stitch in a circular fashion to the underside of a daisy center member (208); wherein the core element will be downwardly suspended beneath the daisy center member (208). At this juncture the stem member (200) is attached to the daisy center member (208) and a broad generally flat daisy calyx (203'') is pushed upwardly on the stem member (200) to dispose the petal loops in a generally horizontal fashion.

As shown in FIGS. 29 thru 32, the open blooming rose (110) is formed by center wrapping the center stitch onto itself, or onto the stem member, and then pushing the portion of the core element below the center stitch upwardly and outwardly; whereupon, the stem attached version may be finished by the addition of a calyx (203) stem wrapping (204) and leaves (205).

The specialized steps required to produce the flower varieties that have not been specifically illustrated may be summarized as follows:

Closed Cap Mums require a daisy calyx to give a realistic impression of the finished flower;

Pom Pom Mums require a wide flat daisy calyx for a realistic impression; while a small daisy calyx is adequate for regular mum varieties; and steps (d)3 and (d)1 can be optionally employed in the wrapping step (d) to produce different visual effects in the finished end products;

Dahlias require that the interior portion of the wrapped core element, prior to the upward and outward folding of the lower portion of the core element; wherein the finished flower will appear to have a flattened center;

Violets require that the value of "y" equals the number "five"; and,

Bachelor Buttons require that the value of "y" equals the number "six".

Pine cones will be treated as a special category of "flower" in that a pine cone is seed bearing; which will cause a debate among many people as to whether a pine cone should be treated as a fruit or nut as opposed to a flower.

For the purposes of this invention, a pine cone is considered to be a variety of flower; and, the special steps required to produce the finished product involve the spiral wrapping of the core element around an enlarged oval substrate (not shown) such as a styrofoam egg or the like to produce the distinctive pine cone configuration of the finished product.

Having thereby described the subject matter of this invention, it should be obvious that many substitutions, modifications, and variations of the invention are possible in light of the above teachings. It is therefore to be understood that the invention as taught and described herein is only to be limited to the extent of the breadth and scope of the appended claims.

I claim:

1. A method of fabricating a variety of artificial flowers from ribbon material wherein said variety of artificial flowers includes: closed rose-buds; crysanthemums; closed cap mums; pom pon mums; dahlias; daisies; open roses; gladiola; violets; poinsettias; bachelor buttons; carnations; azaleas; and hyacinth; wherein the materials required to practice the basic method comprise: ribbon material having diverse lengths, finishes, and widths; needle and thread; and, a generally rectangular open framework member having elongated apertured side elements and a pair of rod elements that are releasably received in selected opposed pairs of apertures that are equidistantly spaced from the center of the respective elongated side elements; wherein the basic method steps comprise:

(a) choosing a selected one of said variety of artificial flowers;

(b) choosing a ribbon material having a selected length, finish, and width corresponding to choice (a);

(c) positioning the rod elements on the apertured side elements of the framework member a predetermined distance "x" apart in accordance with choice (a);

(d) wrapping the length of ribbon around the rod elements a number of times (y), and in accordance with a selected one of the following wrapping patterns: (1) straight wrap; (2) overlapping wrap; and (3) twisted wrap; wherein the beginning and end of each completed wrap are temporarily secured together;

(e) using the needle and thread to form a selected stitching pattern across the center of the ribbon wrap; while the ribbon is still wrapped around the rod elements; wherein the stitching patterns comprise: (1) a straight stitch; (2) a single gather stitch; and, (3) a double gather stitch; and, (f) removing the stitched ribbon wrap from the open framework member.

2. A method as in claim 1; further comprising the step of:

(g) cutting and shaping the cut ends of the ribbon wraps.

3. A method as in claim 2; further comprising the step of:

(h) severing the ribbon wraps intermediate the double gather stitch pattern of step (e)3.

4. A method as in claim 1; wherein, the materials required to practice the basic method further comprise a stem member; and, the basic method steps further comprise:

(i) disposing at least a portion of said stitched ribbon wrap in a selected surrounding relationship with respect to said stem member: wherein, said surrounding relationships comprise: (1) rolled; (2) overlapping wraps; (3) spiral wraps; and, (4) encircling attachment to an intermediate stem related element.

5. A method of forming an artificial closed rosebud according to the following method steps of claim 1:

steps (a) thru (c); step (d)2; step (e)1; and, step (f).

6. A method of forming an artificial closed rosebud according to the following method steps of claim 4:

steps (a) thru (c); step (d)2; step (e)1; step (f); and, step (i)1.

7. A method of forming an artificial closed cap mum according to the following method steps of claim 1:

steps (a) thru (c); step (d)3; step (e)1; and, step (f).

8. A method of forming an artificial closed cap mum according to the following method steps of claim 4:

steps (a) thru (c); step (d)3; step (e)1; step (f); and, step (i)2.

9. A method of forming an artificial pom pom mum according to the following method steps of claim 1:

steps (a) thru (c); step (d)1; step (e)1; and, step (f).

10. A method of forming an artificial pom pom mum according to the method steps of claim 9:

by substituting step (d)3 for step (d)1.

11. A method of forming an artificial pom pom mum according to the following steps of claim 4:

steps (a) thru (c); step (d)1; step (e)1; step (f); and, step (i)2.

12. A method of forming an artificial pom pom mum according to the method steps of claim 11:

by substituting step (d)3 for step (d)1.

13. A method of forming an artificial dahlia according to the following method steps of claim 1:

steps (a) thru (c); step (d)3; step (e)1; and, step (f).

14. A method of forming an artificial dahlia according to the following method steps of claim 4:

steps (a) thru (c); step (d)3; step (e)1; step (f); and, step (i)2.

15. A method of forming an artificial daisy according to the following method steps of claim 1:

steps (a) thru (c); step (d)1; step (e)1; and, step (f).

16. A method of forming an artificial daisy according to the method steps of claim 15:

by substituting step (d)3 for step (d)1.

17. A method of forming an artificial daisy according to the following method steps of claim 4:
steps (a) thru (c); step (d)1; step (e)1; step (f); and, step (i)4.

18. A method of forming an artificial daisy according to the method steps of claim 17:
by substituting step (d)3 for step (d)1.

19. A method of forming an artificial open rose according to the following method steps of claim 1:
steps (a) thru (c); step (d)2; step (e)2; and, step (f).

20. A method of forming an artificial open rose according to the following method steps of claim 4:
steps (a) thru (c); step (d)2; step (e)2; step (f); and, step (i)2.

21. A method of forming an artificial hyacinth according to the following method steps of claim 1:
steps (a) thru (c); step (d)1; step (e)1; and, step (f).

22. A method of forming an artificial hyacinth according to the following method steps of claim 4:
steps (a) thru (c); step (d)1; step (e)1; step (f); and, step (i)3.

23. A method of forming both the upper and lower portions of an artificial azalea according to the following method steps of claim 1:
steps (a) thru (c); step (d)2; step (e)2; and step (f).

24. A method of forming both the upper and lower portions of an artificial azalea according to the following method steps of claim 4:
steps (a) thru (c); step (d)2; step (e)2; step (f); and, step (i)1.

25. A method of forming an artificial gladiola according to the following method steps of claim 3:
steps (a) thru (c); step (d)2; step (e)3; and steps (f) thru (h).

26. A method of forming an artificial gladiola according to the method steps of claim 25:
by substituting step (d)3 for step (d)2.

27. A method of forming an artificial gladiola according to the following method steps of claim 3 and claim 4:
steps (a) thru (c); steps (d)2; step (e)3; steps (f) thru (h); and, step (i)1.

28. A method of forming an artificial gladiola according to the method steps of claim 3 and claim 4:
steps (a) thru (c); step (d)3; step (e)3; steps (f) thru (h); and step (i)1.

29. A method of forming an artificial poinsettia according to the following method steps of claim 3:
steps (a) thru (c); step (d)3; step (e)3; and, steps (f) thru (h).

30. A method of forming an artificial poinsettia according to the following method steps of claim 3 and claim 4:
steps (a) thru (c); step (d)3; step (e)3; steps (f) thru (h); and step (i)1.

31. A method of forming an artificial carnation according to the following method steps of claim 2:
steps (a) thru (c); step (d)2; step (e)2; step (f) and step (g).

32. A method of forming an artificial carnation according to the following method steps of claim 2 and claim 4:
steps (a) thru (c); step (d)2; step (e)2; step (f); step (g); and, step (i)2.

33. A method of forming artificial violets according to the following method steps of claim 3:
steps (a) thru (c); step (d)3; step (e)3; step (f); and step (h).

34. A method of forming artificial violets according to the following method steps of claim 3 and claim 4:
steps (a) thru (c); step (d)3; step (e)3; step (f); stgep (h); and step (i)1.

35. A method of forming artificial bachelor buttons according to the following method steps of claim 3:
steps (a) thru (c); step (d)1; step (e)3; step (f); and, step (h).

36. A method of forming artificial bachelor buttons according to the following method steps of claim 3 and claim 4:
steps (a) thru (c); step (d)1; step (e)3; step (f); step (h); and, step (i)1.

37. The method of claim 35; wherein, the value of "y" equals "6".

38. The method of claim 29; wherein, the value of "y" equals "9".

39. The method of claim 33; wherein, the value of "y" equals "5".

40. The method of claim 25; wherein, the value of "y" equals "3".

41. The method of claim 26; wherein, the value of "y" equals "3".

* * * * *